United States Patent [19]

Berg et al.

[11] Patent Number: 4,882,458

[45] Date of Patent: Nov. 21, 1989

[54] SWITCH DEVICE FOR ACTIVATING AND DEACTIVATING AN ELECTRICALLY OPERATED DRIVING MEMBER OF AN APPLIANCE

[75] Inventors: Anette Berg, Kronberg; Günter Hoffmann, Hofheim, both of Fed. Rep. of Germany

[73] Assignee: Braun Aktiengesellschaft, Kronberg, Fed. Rep. of Germany

[21] Appl. No.: 227,150

[22] Filed: Aug. 2, 1988

[30] Foreign Application Priority Data

Aug. 21, 1987 [DE] Fed. Rep. of Germany ..... 3727921

[51] Int. Cl.[4] ..... H01H 3/20; H01H 9/20

[52] U.S. Cl. ..... 200/52 R; 200/43.11; 200/43.16; 200/43.17; 200/50 R; 200/321; 200/322

[58] Field of Search ..... 200/16 F, 43.01, 43.16, 200/43.18, 43.19, 43.21, 50 R, 50 A, 52 R, 61.58 R, 308, 318, 43.11, 43.17, 321, 322; 30/43.92, 43.6, 34.1, DIG. 1, DIG. 2; 322/26; 323/299; 320/2

[56] References Cited

U.S. PATENT DOCUMENTS

| | | | |
|---|---|---|---|
| 3,839,614 | 10/1974 | Suganowski et al. | 200/43.17 |
| 4,112,271 | 9/1978 | Marchetti | 200/308 X |
| 4,180,712 | 12/1979 | Lutzenberger et al. | 200/16 F X |
| 4,280,026 | 7/1981 | Alessio | 200/43.16 |
| 4,504,707 | 3/1985 | Ochiai | 200/43.17 |
| 4,559,456 | 12/1985 | Yamamoto et al. | 200/5 B X |
| 4,563,552 | 1/1986 | Fushimoto | 200/50 A X |
| 4,631,373 | 12/1986 | Ochiai | 200/43.17 |

FOREIGN PATENT DOCUMENTS

| | | | |
|---|---|---|---|
| 2340450 | 3/1975 | Fed. Rep. of Germany . | |
| 2811637 | 4/1979 | Fed. Rep. of Germany | 200/321 |
| 3315643 | 8/1985 | Fed. Rep. of Germany . | |

*Primary Examiner*—J. R. Scott

[57] ABSTRACT

An appliance switch for an electric shaver is equipped with a safety device guarding against accidental operation, which device is slidable coplanar with the appliance switch, is arranged in a housing and is equipped with positive engagement members which are adapted to be slipped over a latch member of the appliance switch and prevent the latch member from being movable out of its locking position. In this manner, a reliable safeguard is provided preventing accidental operation of the shaver.

15 Claims, 6 Drawing Sheets

SWITCH DEVICE FOR ACTIVATING AND DEACTIVATING AN ELECTRICALLY OPERATED DRIVING MEMBER OF AN APPLIANCE

BACKGROUND OF THE INVENTION

This invention relates to a switch device for an appliance for personal use, comprising an appliance switch actuator for activating and deactivating a driving member capable of being electrically operated in a housing of the appliance, as well as a locking device movable into the actuation path of the appliance switch actuator.

An automatic safety device guarding against accidental operation of rechargeable electric shavers and toothbrushes is already known, comprising a tappet which is carried in the housing and movable against the action of a spring and whose inner end is displaceable into the actuation path of an on-off switching member which is in the off position. In this arrangement, the direction of displacement of the tappet is transverse to the direction of displacement of the on-off switch so that a relatively large amount of space is required for the safety device (DE-PS No. 33 15 643).

By contrast, it is an object of the present invention to provide a switch device of the type initially referred to in which an appliance switch, when in the off position, is reliably guarded against being brought into an on position. It is a further object herein to provide a switch device which is easy to manipulate, can be accommodated in a minimum amount of space and requires a minimum number of components.

These requirements are satisfied in a switch device of the type initially referred to in that the appliance switch actuator and/or the locking device include engagement means which are displaceable into one another or interengageable for securing the appliance switch actuator relative to the locking device in the off position. The use of interengageable positive and frictional engagement means provided on the appliance switch actuator and on the locking device affords a simple method of wedging the application switch actuator relative to the locking device in the off position of the appliance switch actuator, thereby safely locking an appliance switch in the off position so it cannot be actuated in any way, in particular not by accident.

The present invention admits of a variety of embodiments which afford the common advantage that engagement means, in being suitably matched relative to one another, are formed on or molded into three structural elements of the appliance which are operatively associated with one another and include the stationary partition wall of the housing or housing wall, the appliance switch actuator and the locking device.

In an embodiment of the switch device permitting considerable space savings to be realized, the appliance switch actuator and the locking device are mounted on a backing member of the appliance housing in a manner enabling them to be displaced in the same plane of motion. This permits the switch device to be built to a minimum height.

Preferably, the appliance switch actuator includes at least one positive engagement means which is maintained in predetermined switch positions by means of at least one locking member provided on the backing member. For locking purposes, the locking device includes latch members displaceable into notches provided on the backing member. In an embodiment of the invention, the positive engagement means of the appliance switch actuator is an L-shaped resilient latch member having a knob formed on its leg. In a further embodiment of the invention, the positive engagement means of the appliance switch actuator is a U-shaped latch member having a knob formed on each of its elastic legs. In an embodiment of the invention, the positive engagement means of the appliance switch actuator is a bolt formed on the appliance switch actuator. In an embodiment of the invention, the locking member is formed of a web member situated between two oblong openings provided in the backing member. In an embodiment of the invention, the locking member is a bolt formed on the backing member. In an embodiment of the invention, the locking member is a U-shaped latch member formed on the partition wall with a knob on each of its resilient legs. To prevent the positive engagement means of the appliance switch actuator from sliding out of predetermined notches, the locking device includes at least one frictional engagement means which is displaceable into the displacement path of the resilient positive engagement means of the appliance switch actuator.

In another embodiment, the effect identified in the foregoing is accomplished in that the locking device includes at least one frictional engagement means displaceable into the displacement path of the resilient legs of the locking member of the partition wall. The frictional engagement means is preferably an L-shaped latch member which, in the off position of the appliance switch actuator, is adapted to be slipped onto its positive engagement means. In a further embodiment, the frictional engagement means is a U-shaped latch member the legs of which are adapted to be slipped onto the legs of the positive engagement means of the appliance switch actuator in the off position of the appliance switch actuator. In a still further embodiment, the frictional engagement means is a U-shaped latch member whose bar connecting the legs is slidable between the legs of the positive engagement means. The knobs provided on the latch members of the appliance switch actuator and of the locking device provide simple constructional means for accomplishing an operating sequence of both, including a latching function, in that for the knobs of both the notches are formed in at least one of the longitudinal sides of the partition wall by means of projections formed thereon.

BRIEF DESCRIPTION OF THE DRAWINGS

Further advantages and details of the invention will become apparent from the subsequent description and the drawings illustrating some preferred embodiments. In the drawings.

DESCRIPTION OF THE PREFERRED EMBODIMENTS

Figure 1:
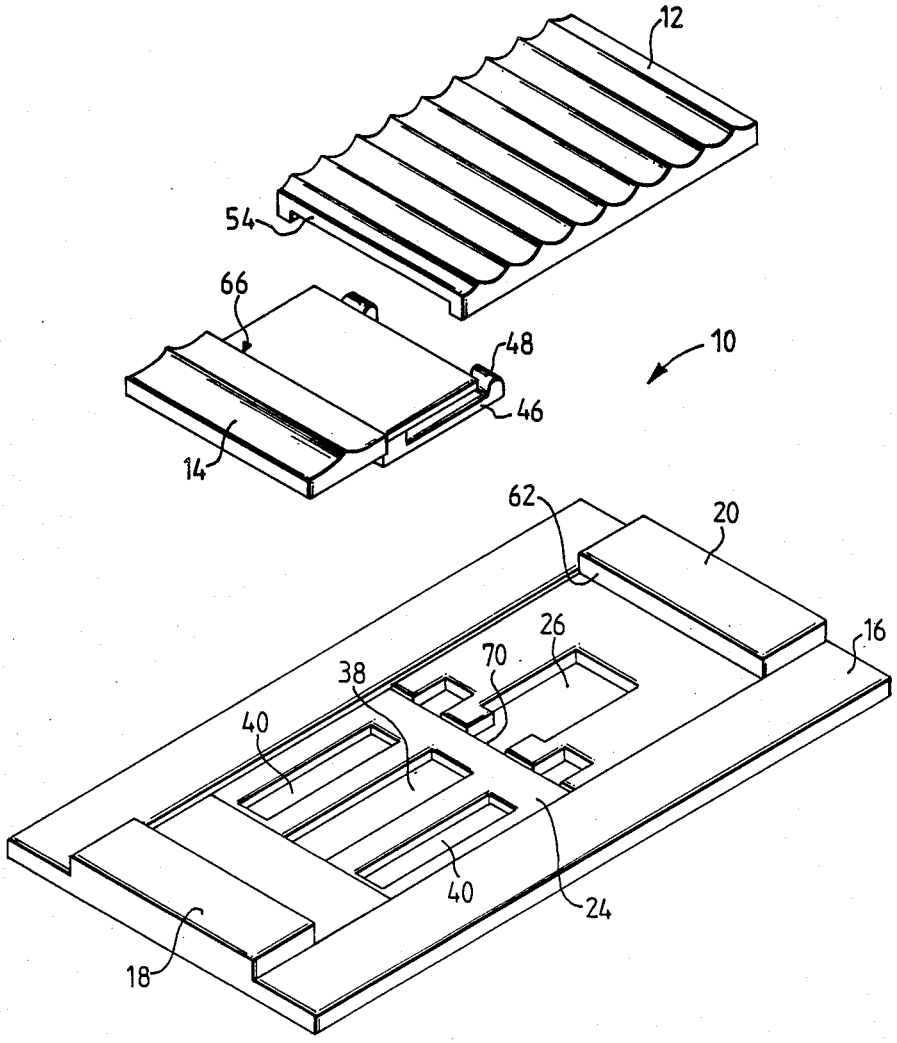
FIG. 1 is an exploded perspective view of the individual parts of a switch device from above.
Figure 2:
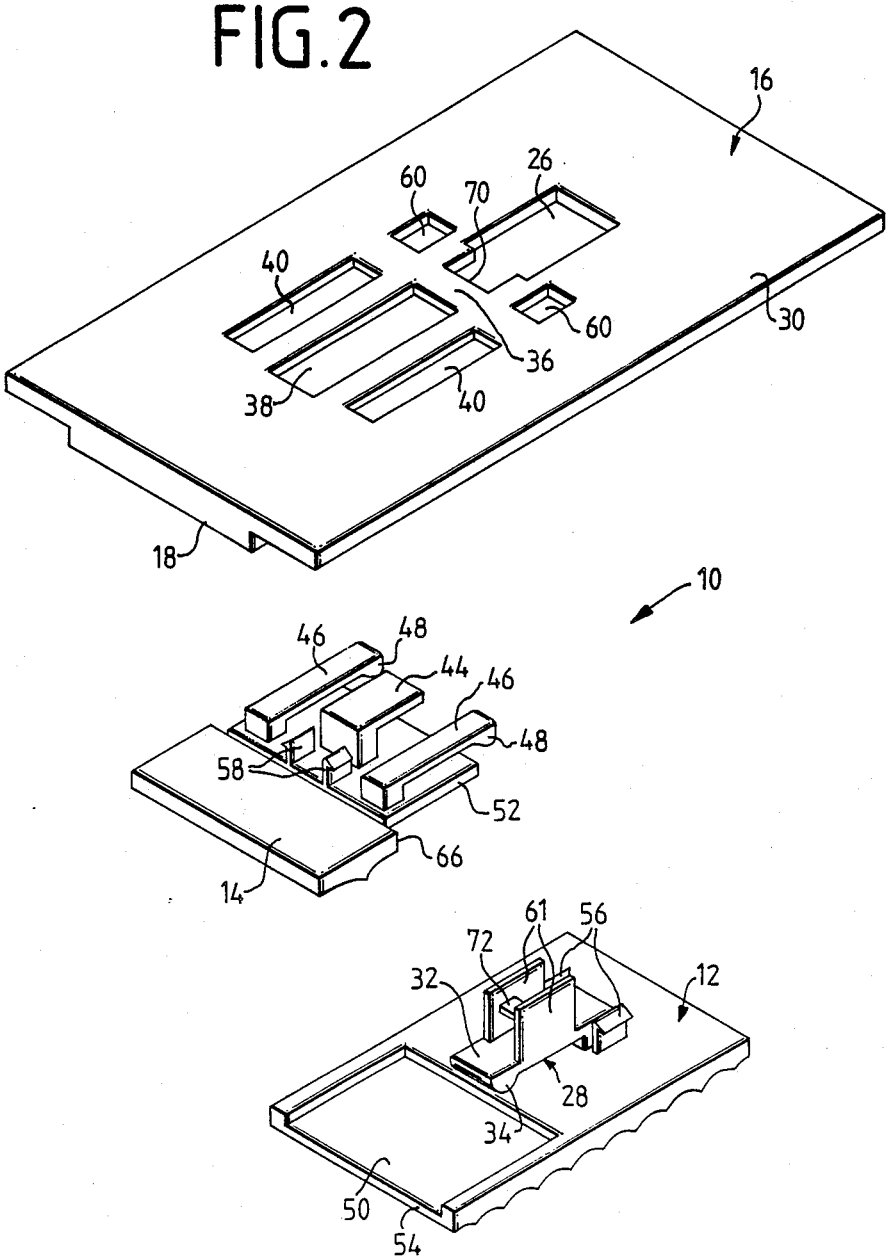
FIG. 2 is an exploded perspective view of the switch device of FIG. 1 from below.

Referring now to FIGS. 1 and 2, there are shown in perspective the individual parts of an embodiment of a switch device 10 for an appliance for personal use, for example, for an electric shaver or a toothbrush. In the subsequent FIGS. 3*a* to 3*c,* this embodiment is shown in section in assembled condition and will be explained in more detail in the following with reference to these figures.

The switch device 10 comprises an appliance switch actuator 12 and a locking device 14 which are slidably received in a backing member 16. The backing member 16 is part of a housing, not shown in the drawings, in which a driving member adapted to be operated electrically for operating the appliance is provided. The backing member 16 is comprised of a rectangular recess or cutout 24 provided in the housing wall of the appliance and serving to receive the appliance switch actuator 12 and the locking device 14, including a forward limit stop member 18 and a rearward limit stop member 20.

Figure 3A:
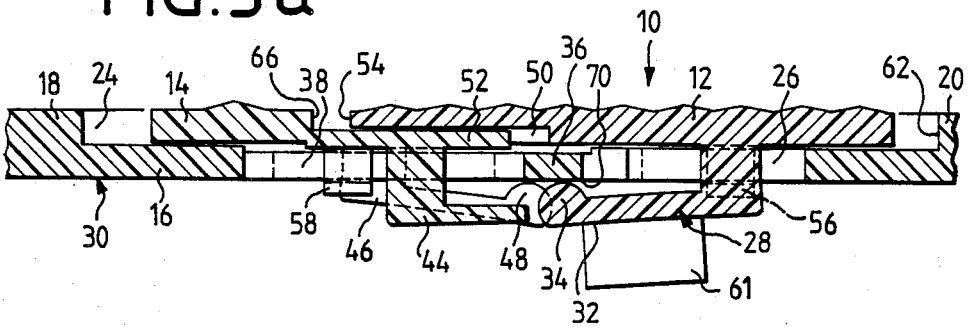
FIG. 3*a* is a section through the switch device of FIGS. 1 and 2.

On the axis of symmetry of the backing member 16 is a rectangular opening 26 which serves to receive an L-shaped latch member 28 whose leg 32 extending parallel to the underside 30 of the backing member 16 has at its end a knob 34 abutting against a web member 36 of the backing member 16 in the operating position of the appliance switch actuator 12. The web member 36 bounds the left-hand end of the opening 26 and the right-hand end of an oblong opening 38 serving to receive the knob 34 when the appliance switch actuator 12 is shifted to the left as shown in FIG. 3*c*. In this position, the knob 34 provided on the leg 32 of the latch member 28 is engaged in the oblong opening 38. The L-shaped latch member 44 is formed on the locking device 14 and extends through the oblong opening 38 bounded by the web member 36. Extending parallel to the oblong opening 38 are two further oblong openings 40 which are somewhat shorter than the oblong opening 38. The oblong openings 40 serve to receive two equally L-shaped latch members 46 having knobs 48 at their respective ends. Advantageously, the latch members 28 and 46 are resilient so that they bend slightly upwardly as they glide along the underside 30 of the backing member 16, until the knobs 34 and 48 lock into corresponding recesses.

Figure 3B:
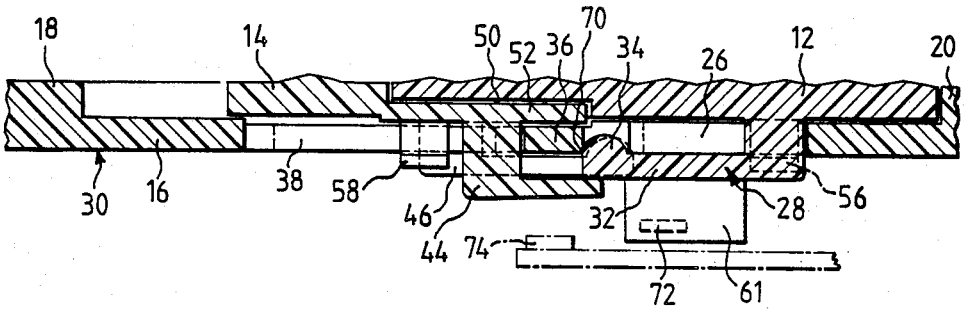
FIG. 3*b* is a section through the switch device of FIGS. 1 and 2, with an appliance actuator shown in the off position and a locking device locking the appliance switch actuator in place.
Figure 3C:
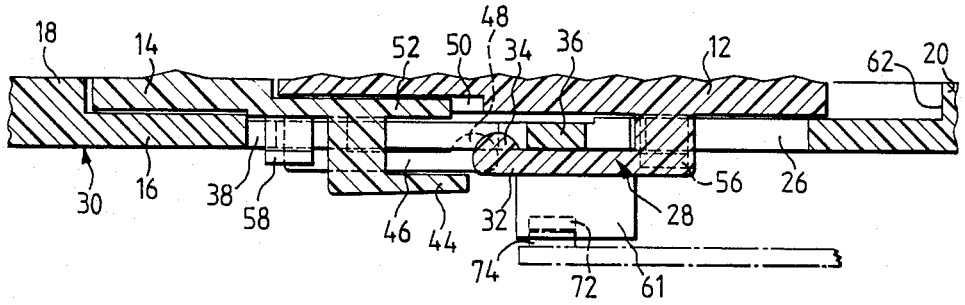
FIG. 3*c* is a section through the switch device of FIGS. 1 and 2, with an appliance switch actuator shown in the on position and released by the locking switch device.

To enable the latch member 44 of the locking device 14 to be slipped onto the latch member 28 of the appliance switch actuator 12 when the appliance switch actuator 12 is in the off position as shown in FIG. 3*b,* the appliance switch actuator 12 is provided with a cutout 50 for sliding engagement by the forward end portion 52 of the locking device 14 until the end 66 of the locking device 14 is in abutment with the end 54 of the appliance switch actuator 12.

The latch member 28 of the appliance switch actuator 12 has on either side thereof small hooks 56 which abut the underside 30 of the backing member 16 and are formed fast with the appliance switch actuator 12. The hooks 56 extend likewise through the opening 26, thus securing the latch member 28 against slipping out of the opening 26. If it is desired to remove the appliance switch actuator 12 with its latch member 28 from the opening 26, only the top opposed hook members 56 have to be slightly compressed, whereby the upper part of the hook member becomes disengaged from the underside 30 of the backing member 16. The appliance switch actuator 12 is then readily removable from the opening 26. To secure the locking device 14, the locking device 14 equally includes two hooks 58 which, according to FIGS. 3*a* to 3*c,* secure the locking device 14 to the backing member 16 while permitting an adjustment of the locking device 14. With their knobs 48, the two parallel latch members 46 of the locking device 14 lockingly engage into recesses or cutouts 60 when the locking device has been shifted all the way to the right as shown in FIG. 3*b*.

In FIG. 3*b,* the appliance switch actuator 12 is in its off position and is secured against unintentional operation by means of the locking device 14. In FIG. 3*a,* the locking device 14 and the appliance switch actuator 12 are in a mid-position in which the knobs 48 of the legs 46 of the locking device 14 as well as the knob 34 of the leg 32 of the appliance switch actuator resiliently engage the web member 36. For example, when the appliance switch actuator 12 is shifted all the way to the right to an off position as shown in FIG. 3*b,* the appliance switch actuator 12 rests with its grip member against an edge 62 of the limit stop member 20 of the backing member 16, whereby further movement of the appliance switch actuator 12 to the right is prevented. At the same time, the knob 34 is moved behind the web member 36, lockingly engaging into the opening 26 due to the resilient property of the latch member 28. This then enables the locking device 14 to be shifted to the right, in which process the L-shaped latch member 44 glides over the L-shaped latch member 28, thus preventing the knob 34 from disengaging from the opening 26. This reliably prevents the appliance switch actuator 12 from being moved from its off position to the left into an operating position, because the knob 34, locked by the L-shaped latch member 44 of the locking device 14, is only allowed to abut the edge 70 of the web member 36. In addition, slipping the latch member 44 on the latch member 28 causes the two latch members to become frictionally engaged, this being due to the friction occurring between the underside of the latch member 44 and the surface of the latch member 28. Further, the latch member 44 may be provided with a knob not shown in the drawings for locking engagement with recesses provided on the surface of the latch member 28. This produces an additional clamping or wedging effect between the latch member 44 and the latch member 28. Upon having assumed the position shown in FIG. 3*b,* the appliance switch actuator 12 and the locking device 14 are thus secured by positive engagement means and frictional engagement means. Because the appliance switch actuator 12 and the locking device 14 can be displaced and interengaged in a common plane, the overall height of construction of the switch device 10 is significantly reduced compared to conventional switch devices. Further, with the locking device 14 assuming the position shown in FIG. 3*b*, the knobs 48 of the latch members 46 lock into the cutouts 60 of the backing member 16. This provides for positive engagement between the locking device 14 and the backing member 16. If it is desired to shift the appliance switch actuator 12 into an operating position, first the locking device 14 has to be shifted all the way to the left until it abuts the limit stop member 18, in which process the knobs 48 are disengaged from the cutouts 60 and moved into the oblong openings 40 via the web member 36. At the same time, the L-shaped latch member 44 releases the latch member 28 of the appliance switch actuator 12. If the appliance switch actuator 12 is then shifted to the left, the knob 34 will glide along the underside 30 of the backing member 16 via the web member 36 into the oblong opening 38 until the end 54 of the appliance switch actuator 12 abuts an end 66 of the locking device 14. Due to the absence of a locking action by the L-shaped latch member 44, the appliance switch actuator 12 can be returned from this operating position shown in FIG. 3*c* to the right into the off position and moved back into the on position at any time.

In FIG. 3*b*, the appliance switch actuator 12 is shown in its off position in which the knob 34 abuts an edge 70 of the web member 36 bounding the opening 26. In this position, the contact element 72 provided between the walls 61 is spaced from a further contact element 74 provided in the housing of the appliance, so that the circuit of the electric drive of the appliance is open. To secure the latch member 28 in position, an L-shaped latch member 44 is slipped over the forward end of the latch member 28, thus preventing the knob 34 from moving via the edge 70 and the web member 36 on the underside 30 of the backing member 16 or the housing. The latch member 44 thus prevents shifting of the appliance switch actuator 12 into an operating position.

To shift the appliance switch actuator 12 into an operating position as illustrated in FIG. 3*c*, only the locking device 14 has to be moved to the left, thus enabling the knob 34 to be moved via the edge 70 of the web member 36 into the oblong opening 38 serving to receive the latch member 28 of the appliance switch actuator 12. In the process, the knob 34 resiliently engages into the oblong opening 38 via the web member 36 due to the resilience of the latch member 28. In this operating position, the electrical contact element 72 picked up by the appliance switch actuator 12 engages the contact element 74, thereby closing the electric circuit for operating the electric drive of the appliance.

In the further embodiments illustrated in FIGS. 4a to 6*b*, locking device and appliance switch actuator are equipped with U-shaped latch members which, being interengageable, serve to secure the appliance switch actuator.

Figure 4A:
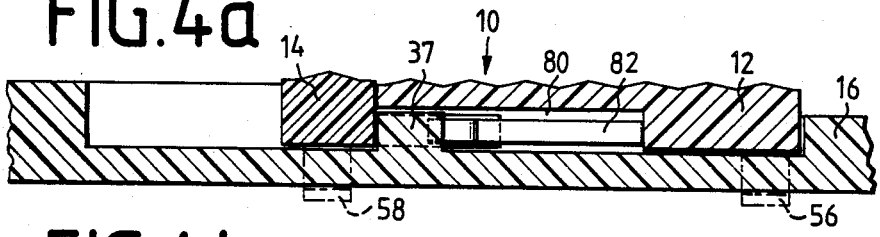
FIG. 4*a* is a section through a switch device with U-shaped latch members formed on both the appliance switch actuator and the locking device.
Figure 4B:
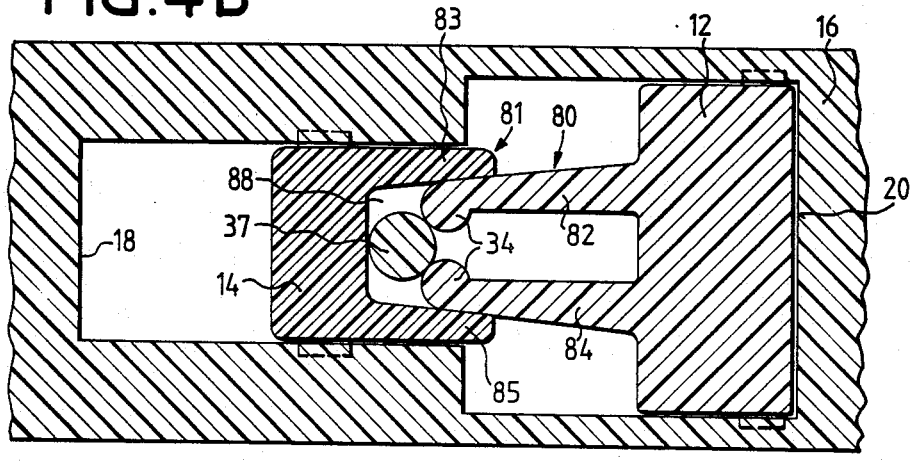
FIG. 4*b* is another section through the switch device of FIG. 4*a;*

As becomes apparent from FIGS. 4*a* and 4*b*, the appliance switch actuator 12 is likewise slidably received in a backing member 16 or a housing and equipped with a U-shaped latch member 80 comprising two parallel resilient legs 82 and 84 having knobs 34 at their respective ends. When the appliance switch actuator 12 is moved from an operating position into its off position as shown in FIG. 4*b*, the two knobs 34 are moved past a boss 37 provided on the backing member 16 until they abut the rear side of the boss. To prevent the appliance switch actuator 12 from being shifted further, the locking device 14 is slipped with its U-shaped cutout 88 onto the legs 82 and 84 of the latch member 80, with the legs 83 and 85 providing a clamping effect on the legs 82 and 84. On a movement of the appliance switch actuator 12 to the left, the two legs 82 and 84 can no longer be spread apart, so that an adjustment of the appliance switch actuator 12 is prevented due to the legs 82 and 84 resting against the fixed boss 37. An adjustment of the appliance switch actuator 12 is not possible until after the locking device 14 has been moved to the left, enabling the knobs 34 to be moved past the boss 37 again.

Figure 5A:
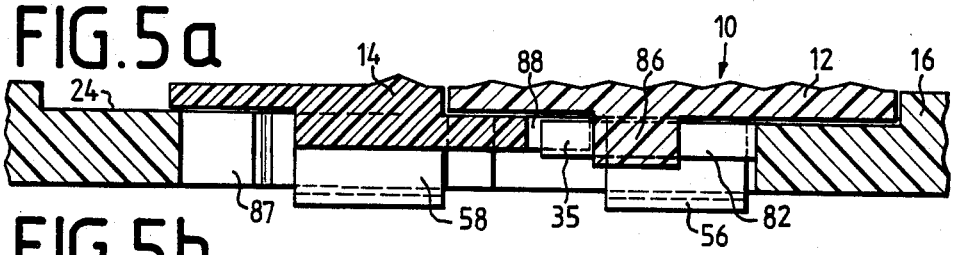
FIG. 5*a* is a section through an appliance switch illustrating another embodiment thereof.
Figure 5B:
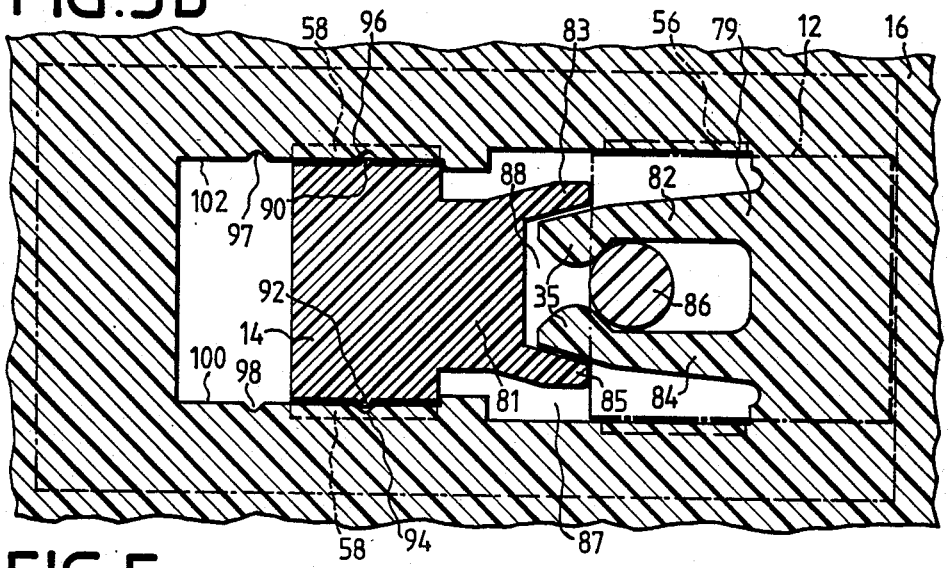
FIG. 5*b* is a top plan view, in section, of the device of FIG. 5*a,* with the locking switch including knobbed legs in parallel arrangement which embrace a boss in the off position of the appliance switch.

In the embodiment of FIGS. 5*a* and 5*b*, the partition wall 16 includes an opening 87 extending through the partition wall as well as a recess 24 limiting the displacement travel of the appliance switch actuator 12 and the locking device 14. Within the opening 87, the partition wall 16 has formed thereon a U-shaped latch member 79 comprising two resilient legs 82 and 84 having knobs 35 at their respective ends. With the appliance switch actuator 12 in the off position as shown in FIGS. 5a and 5b, the legs 82 and 84 embrace with their knobs 35 the boss 86 which is integrally formed with the appliance switch actuator 12. The locking device 14 is provided with a U-shaped latch member 81 extending into the opening 87, its legs 83 and 85 embracing the legs 82 and 84 to prevent straddling of the legs 82 and 84 which may be caused by the boss 86 displaceable with the appliance switch actuator 12. Transversely to the sliding direction of the locking device 14, two locking means 90 and 92 are provided on the locking device 14 which, in dependence on the switch position of the locking switch device 14, engage into locking grooves 94, 96 or 97, 98 provided in the side walls 100 and 102 of the opening 87. The locking means 90 and 92 are preferably formed on two resilient hooks 58 which, for ease of assembly and holding of the locking device 14 in the opening 87 of the partition wall 16—as shown in FIG. 5*d*—, are provided on the locking device 14 in a manner partly engaging the partition wall 16 from below, with the locking means 90, 92 being dimensioned such that, by utilizing the resilient properties of the hooks 58, a displacement of the locking device 14 can be performed while at the same time the locking device 14 continues to be held by means of the hooks 58.

Figure 5C:
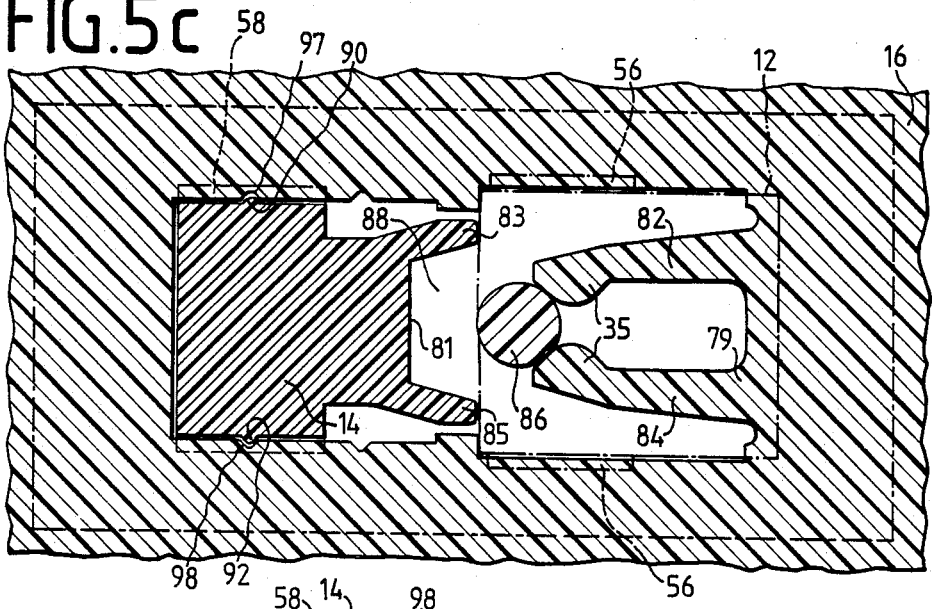
FIG. 5*c* is a section through the switch of FIG. 5*a* and FIG. 5*b* in operating position.
Figure 5D:
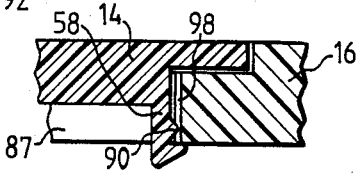
FIG. 5*d* is a section showing details of the latching device of the locking device.

As shown in FIGS. 5*a* to 5*c*, resilient hooks 56 are also formed on the appliance switch actuator 12 in the area of the side walls 100, 102 of the partition wall 16, the hooks partly engaging the partition wall 16 from below to guide and hold the appliance switch actuator 12.

In the representations of FIGS. 5*a* and 5*b*, the appliance switch actuator 12 is in its off position in which it is secured against inadvertent sliding movements by means of the locking device 14. The locking means 90 and 92 of the locking device are in engagement with corresponding locking grooves 94 and 96. The legs 83 and 85 of the Ushaped latch member of the locking device 14 embrace the resilient legs 82 and 84 of the U-shaped latch member 79, thereby preventing straddling of these legs 82 and 84 which is necessary for a release or displacement of the appliance switch 12 whose boss 86 situated between the legs 82 and 84 is secured against displacement by the legs 82 and 84 and the knobs 35 formed thereon.

Shifting the locking device 14 to the left into the position shown in FIG. 5*c* in which the locking means 90 and 92 are in engagement with the locking grooves 97 and 98 releases the locking action of the legs 83 and 85 on the legs 82 and 84. This then enables the appliance switch actuator 12 to be also moved to the left into an operating position, with the boss 86 acting on the knobs 35 and causing straddling of the legs 82 and 84 while use is made of the resilient properties of these legs, the boss 86 thus slipping through between the knobs 35 to assume the position shown in FIG. 5*c* which corresponds to the operating position of the appliance switch 12, in which position the electric circuit of an electric drive is closed by a contact element provided on the appliance switch actuator 12 yet not shown in FIGS. 5*a* to 5*c*.

Through the boss 86, the appliance switch actuator 12 is held in both the operating position and the off position by the resilient legs 82, 84 and the knobs 35 formed thereon, and it is movable from one switch position into the other switch position by utilizing the resilient properties of the legs 82, 84. In the off position, the appliance switch actuator 12 can be secured against any sliding motion acting on the appliance switch actuator 12 by means of slipping the legs 83 and 85 of the U-shaped latch member 81 of the locking device 14 onto the legs 82 and 84 of the partition wall 16.

Figure 6A:
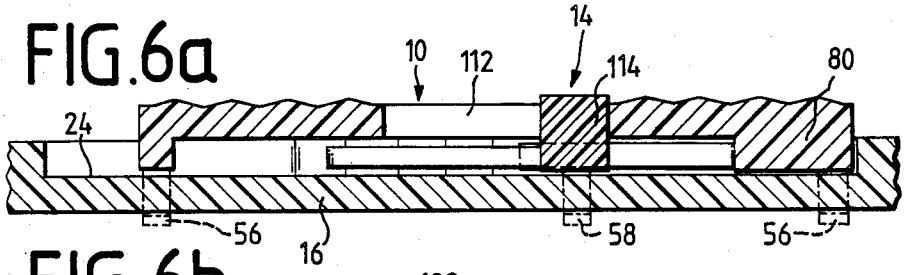
FIG. 6*a* is a section through a switch device with U-shaped latch members illustrating a further embodiment.
Figure 6B:
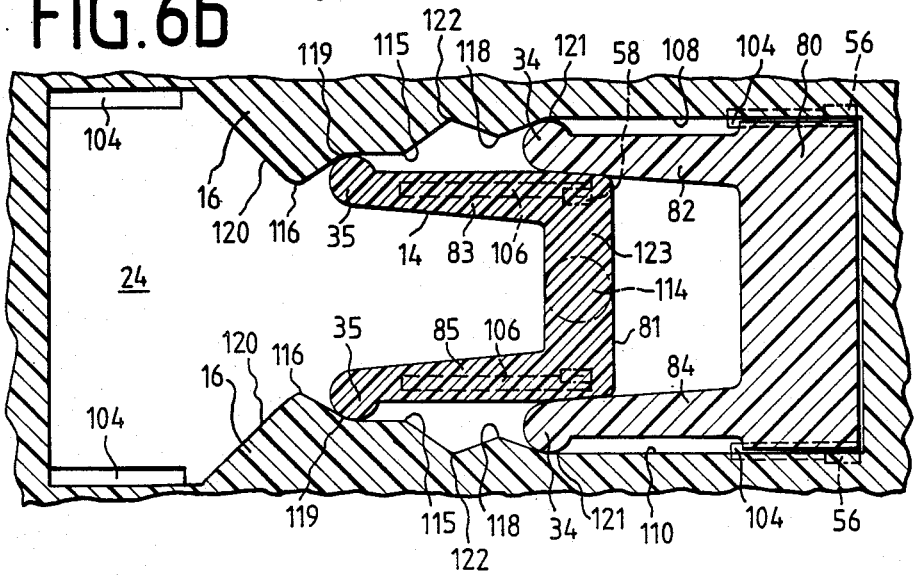
FIG. 6*b* is a top plan view, in section, of the appliance switch of FIG. 6*a*.

In the embodiment of FIGS. 6*a* and 6*b*, the partition wall 16 includes a recess 24 receiving the appliance switch actuator 12 and the locking device 14 in a slidable relationship thereto. The appliance switch actuator 12 is slidably mounted by means of four hooks 56 which extend through corresponding oblong openings 104 provided in the partition wall 16 and engage the partition wall 16 from below. To slidably mount the locking device 14 on the partition wall 16, two further oblong openings 106 are provided in the partition wall 16 through which corresponding hooks 58 formed on the locking device 14 extend and engage the partition wall 16 from below.

On the appliance switch actuator 12, a U-shaped latch member 80 is provided whose resilient legs 82 and 84 with the knobs 34 formed thereon rest against the two longitudinal side walls 108 and 110 of the recess 24. The locking device 14 is comprised of a U-shaped member 81 which is engageable between the legs 82 and 84 and has resilient legs 83 and 85 provided with knobs 35 resting against the longitudinal side walls 108 and 110, and of an actuation member 114 arranged to extend through an opening 12 provided in the appliance switch actuator 12, with the opening 112 being fashioned such as to ensure an unhindered displacement of the locking device 14 via the actuation member 114.

Formed in the longitudinal side walls 108 and 110 by means of projections 115, 116, 118 are notches 121, 122, 119 and 120 in which the knobs 34, 35 of the lens 82, 84, 83 and 85 extending in the same direction engage in order to maintain both the appliance switch actuator 12 and the locking device 14 in switch positions determined by the respective notch.

In FIG. 6*b*, the appliance switch actuator 12 is in its off position in which it is secured in place by the locking device 14 engaged between the legs 82 and 84. By displacing the locking device 14 to the left whereby the resilient legs 83 and 85 spring with their knobs 35 over projections 116 provided in the side walls 108 and 110, the locking device 14 is moved from the locking position shown to a release position in which the knobs 35 are in engagement with the notches 120. The appliance switch actuator 12, which is accordingly unlocked can then be moved, on account of the resilient legs 82 and 84, from the off position shown to the operating position which is attained after the knobs 34 provided on the legs 82 and 84 have overcome the projections 118. The appliance switch actuator 12 is provided with a contact element not shown which in the operating position of the appliance switch actuator closes the electric circuit of an electric drive.

We claim:

1. A switch device for an appliance for personal use, comprising an appliance switch actuator movable along a straight line path for activating and deactivating a driving member capable of being electrically operated in a housing of the appliance, as well as a locking device movable in a path parallel to said path of movement of said appliance switch actuator into the actuation path of the appliance switch actuator, said appliance switch actuator and said locking device including engagement means which are interengageable for securing said appliance switch actuator relative to said locking device in the off position.

2. A switch device as claimed in claim 1 and further including backing structure that includes at least one locking member and wherein said appliance switch actuator includes at least one positive engagement means which is maintained in a predetermined switch position by means of said locking member.

3. A switch device as claimed in claim 1 and further including backing structure and wherein said locking device includes latch members displaceable into notches provided on said backing member.

4. A switch device as claimed in claim 2 wherein said positive engagement means of said appliance switch actuator is an L-shaped resilient latch member that has a leg and a knob formed on said leg.

5. A switch device as claimed in claim 2 wherein said positive engagement means (80) of said appliance switch actuator is a U-shaped latch member that has two elastic legs and a knob formed on each of its elastic legs.

6. A switch device as claimed in claim 2 wherein said positive engagement means (86) of said appliance switch (12) is a boss formed on the appliance switch actuator.

7. A switch device as claimed in claim 2 wherein said locking member is formed of a web member situated between two oblong openings provided in said backing member.

8. A switch device as claimed in claim 2 wherein said locking member is a boss formed on said backing member.

9. A switch device as claimed in claim 2 wherein said locking member is a U-shaped latch member formed on said partition wall (16) that has two resilient legs and having a knob (35) formed on each of its resilient legs (82, 84).

10. A switch device as claimed in claim 2 wherein said locking device includes at least one frictional engagement means which is displaceable into the displacement path of said positive engagement means of the appliance switch actuator.

11. A switch device as claimed in claim 9 or claim 10 wherein said locking device includes at least one frictional engagement means which is displaceable into the displacement path of the resilient legs of the locking member of the partition wall.

12. A switch device as claimed in claim 10 wherein said frictional engagement means (44) is an L-shaped latch member which, in the off position of the appliance switch actuator is in engagement with its positive engagement means.

13. A switch device as claimed in claim 10 wherein said frictional engagement means is a U-shaped latch member that has two legs, said legs being in engagement with the legs of the positive engagement means of the appliance switch actuator in the off position of the appliance switch actuator.

14. A switch device as claimed in claim 10 wherein said frictional engagement means is a U-shaped latch member whose bar connecting the legs is slidable between the legs of the positive engagement means.

15. A switch device a claimed in claim 10 wherein said notches are formed in at least one of the longitudinal sides of the partition wall by means of projections formed thereon.

* * * * *